US008941399B2

(12) United States Patent
Hara et al.

(10) Patent No.: US 8,941,399 B2
(45) Date of Patent: Jan. 27, 2015

(54) POSITION DETECTING DEVICE

(71) Applicant: Denso Corporation, Kariya, Aichi-pref. (JP)

(72) Inventors: Tetsuya Hara, Kariya (JP); Yoshiyuki Kono, Obu (JP); Toru Shimizu, Nagoya (JP); Takamitsu Kubota, Chiryu (JP)

(73) Assignee: Denso Corporation, Kariya (JP)

( * ) Notice: Subject to any disclaimer, the term of this patent is extended or adjusted under 35 U.S.C. 154(b) by 164 days.

(21) Appl. No.: 13/709,362

(22) Filed: Dec. 10, 2012

(65) Prior Publication Data

US 2013/0166172 A1 Jun. 27, 2013

(30) Foreign Application Priority Data

Dec. 22, 2011 (JP) ..... 2011-281334

(51) Int. Cl.
*G01R 31/08* (2006.01)
*F02D 45/00* (2006.01)
*F02D 11/10* (2006.01)

(52) U.S. Cl.
CPC ..... *F02D 45/00* (2013.01); *F02D 11/106* (2013.01); *F02D 11/107* (2013.01)
USPC ..... 324/713; 324/522

(58) Field of Classification Search
USPC ..... 324/522, 713, 378, 379
See application file for complete search history.

(56) References Cited

U.S. PATENT DOCUMENTS

| | | | | |
|---|---|---|---|---|
| 5,260,877 | A | 11/1993 | Drobny et al. | |
| 6,075,371 | A * | 6/2000 | Kitamura | 324/716 |
| 2001/0004213 | A1 * | 6/2001 | Kubota et al. | 324/528 |
| 2003/0116741 | A1 | 6/2003 | Kawai et al. | |
| 2007/0240690 | A1 | 10/2007 | Nanba | |

FOREIGN PATENT DOCUMENTS

| | | |
|---|---|---|
| JP | 2-251702 | 10/1990 |
| JP | 3-202784 | 9/1991 |
| JP | 4-214949 | 8/1992 |
| JP | 7-222477 | 8/1995 |
| JP | 2000-166205 | 6/2000 |

* cited by examiner

*Primary Examiner* — Vincent Q Nguyen
(74) *Attorney, Agent, or Firm* — Nixon & Vanderhye PC

(57) ABSTRACT

A first integrated circuit includes a first voltage output circuit for outputting a voltage, which proportionally increases in correspondence to an angular position of a throttle valve, a first protective resistor, a first output terminal connected to the first protective resistor, and a first abnormality detection circuit for outputting a first abnormality detection signal based on a voltage produced by the first protective resistor. A second integrated circuit is configured similarly to the first integrated circuit by a second voltage output circuit, a second protective resistor, a second output terminal, and a second abnormality detection circuit.

16 Claims, 7 Drawing Sheets

| BIT SPECIFYING FIRST IC | BIT SPECIFYING SECOND IC |
|---|---|
| 1 (CONTROL IC) | 0 (MONITOR IC) |

| | COMPARISON RESULT | COMPARISON OUTPUT | FIRST SWITCH ON/OFF |
|---|---|---|---|
| FIRST IC | V1 ≥ Vr | 1 | OFF |
| | V1 < Vr | 0 | ON |
| | COMPARISON RESULT | COMPARISON OUTPUT | SECOND SWITCH ON/OFF |
| SECOND IC | V2 ≥ Vr | 1 | OFF |
| | V2 < Vr | 0 | ON |

| CURRENT AT IGON-TIME | CONTROL IC | | | |
|---|---|---|---|---|
| | ABNORMAL-TIME SWITCH SETTING INFORMATION BIT | NORMAL | SHORT-CIRCUIT | |
| | | FIRST HISW & FIRST LOSW | FIRST HISW | FIRST LOSW |
| FLOW-IN | 1 | OFF | ON | OFF |
| FLOW-OUT | 0 | OFF | OFF | ON |

FIG. 9 COMPARATIVE EXAMPLE
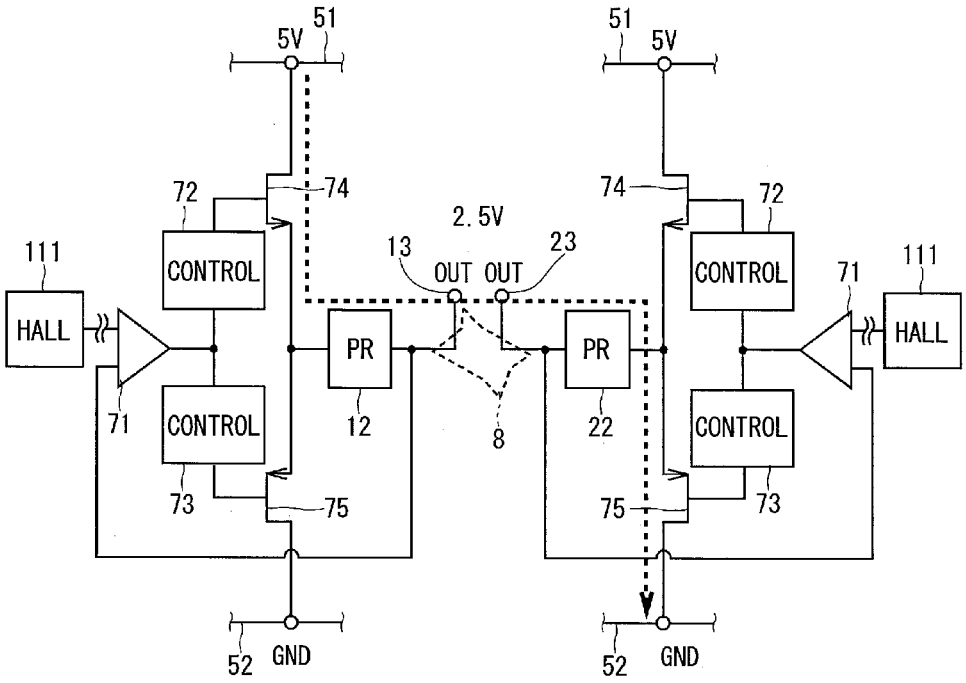

FIG. 10

| CURRENT AT IGON-TIME | NORMAL | | SHORT-CIRCUIT | |
|---|---|---|---|---|
| | CONTROL IC | MONITOR IC | CONTROL IC | MONITOR IC |
| | FIRST HISW & FIRST LOSW | SECOND HISW & SECOND LOSW | FIRST HISW & FIRST LOSW | SECOND HISW & SECOND LOSW |
| FLOW-IN | OFF | OFF | OFF | OFF |
| FLOW-OUT | OFF | OFF | OFF | OFF |

FIG. 11A

| THROTTLE SYSTEM | NORMAL | | SHORT-CIRCUIT | |
|---|---|---|---|---|
| | CONTROL IC | MONITOR IC | CONTROL IC | MONITOR IC |
| SYSTEM BIT | 1 | 1 | 1 | 1 |
| FIRST HISW | OFF | — | ON | — |
| FIRST LOSW | OFF | — | OFF | — |
| SECOND HISW | — | OFF | — | OFF |
| SECOND LOSW | — | OFF | — | OFF |

FIG. 11B

| ACCELERATOR MODULE | NORMAL | | SHORT-CIRCUIT | |
|---|---|---|---|---|
| | CONTROL IC | MONITOR IC | CONTROL IC | MONITOR IC |
| SYSTEM BIT | 0 | 0 | 0 | 0 |
| FIRST HISW | OFF | — | OFF | — |
| FIRST LOSW | OFF | — | ON | — |
| SECOND HISW | — | OFF | — | OFF |
| SECOND LOSW | — | OFF | — | OFF |

POSITION DETECTING DEVICE

CROSS REFERENCE TO RELATED APPLICATION

The present application is based on and incorporates herein by reference Japanese patent application No. 2011-281334 filed on Dec. 22, 2011.

FIELD

The present disclosure relates to a position detecting device for detecting a position of a movable body.

BACKGROUND

A conventional position detecting device is used to detect a rotation angle of a throttle valve in an electronically-controlled throttle system of a vehicle, a rotation angle of an accelerator pedal of an accelerator pedal module, a rotation angle of a tumble control valve and the like. For example, JP 3588127 (U.S. Pat. No. 5,260,877) discloses a position detecting device having two integrated circuits, which generate output signals varying in opposite directions.

This position detecting device is detected as being abnormal when a sum of the output signals is not fixed, because the sum of the output signals of the two integrated circuits having a cross output characteristic is assumed to be fixed in a normally operating state. When the output terminals of the two integrated circuits are short-circuited, the outputs of the position detecting devices become fixed. Therefore, it is impossible to detect abnormality of short-circuiting of output terminals of the position detecting device. Unless otherwise defined specifically, "abnormality" means a short-circuit abnormality.

SUMMARY

It is an object to provide a position detecting device, which is capable of detecting a short-circuit between output terminals of two integrated circuits.

According to one aspect, a position detecting device is provided for outputting a voltage to an electronic control unit, which controls a movable body, in accordance with a position of the movable body. The position detecting device includes a first integrated circuit and a second integrated circuit. The first integrated circuit includes a first voltage output circuit for outputting a first voltage varying with movement of the movable body, a first protective resistor having one end side connected to the first voltage output circuit, and a first output terminal connecting an other end side of the first protective resistor to the electronic control unit. The second integrated circuit includes a second voltage output circuit for outputting a second voltage varying with movement of the movable body, a second protective resistor having one end side connected to the second voltage output circuit, and a second output terminal connecting an other end side of the second protective resistor to the electronic control unit.

The first integrated circuit further includes a first abnormality detection circuit for outputting a first abnormality detection signal based on a potential difference between both ends of the first protective resistor. The second integrated circuit further includes a second abnormality detection circuit for outputting a second abnormality detection signal based on a potential difference between both ends of the second protective resistor.

BRIEF DESCRIPTION OF THE DRAWINGS

The above and other objects, features and advantages of embodiments of a position detecting device will become more apparent from the following detailed description made with reference to the accompanying drawings. In the drawings:

FIG. 9 is a circuit diagram of a comparative example relative to the first embodiment;

FIG. 10 is illustration showing abnormal-time switch setting information of a position detecting device according to a second embodiment; and FIG. 11A and FIG. 11B are illustrations showing abnormal-time switch setting information of a position detecting device in a third embodiment.

EMBODIMENT

First Embodiment

A position detecting device according to a first embodiment is provided as a rotation angle sensor of an electronically-controlled throttle system, which controls an amount of air suctioned into cylinders of an internal combustion engine of a vehicle.

Figure 1:
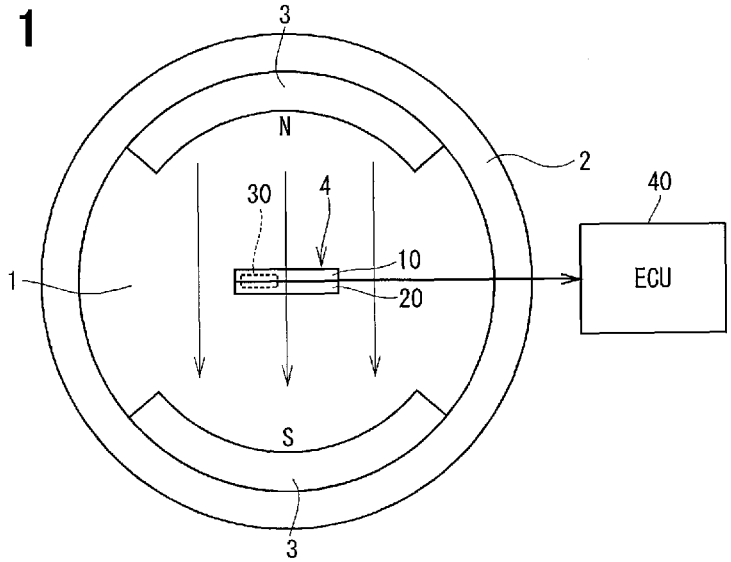
FIG. 1 is a schematic view of an electronically-controlled throttle system including a position detecting device according to a first embodiment.

As shown in FIG. 1, a throttle angle sensor 4 is provided to output a voltage signal indicating an open angle θ of a throttle valve 1 to an electronic control unit (ECU) 40. The ECU 40 is configured to output a drive signal corresponding to the inputted voltage signal to a motor (not shown), which drives the throttle valve 1, so that the throttle valve 1 is driven to an open angle suitable for an operating condition of the internal combustion engine. The motor thus drives the throttle valve 1 to attain a target open angle thereby to regulate the amount of suctioned air.

A cylindrical yoke 2 and two permanent magnets 3 are fixed to one end of the throttle valve 1, which is a movable body. The permanent magnets 3 are attached to the radially inside surface of the yoke 2. Magnetic flux, which flows between the two permanent magnets 3, is indicated schematically by arrows.

The rotation angle sensor 4 includes a first integrated circuit (first IC) 10, a second integrated circuit (second IC) 20 and a microcomputer 30, which are provided rotatably relative to the permanent magnets 3 and the yoke 2. The first integrated circuit 10, the second integrated circuit 20 and the microcomputer 30 will be described in detail with reference to FIG. 2 and FIG. 3.

Figure 2:
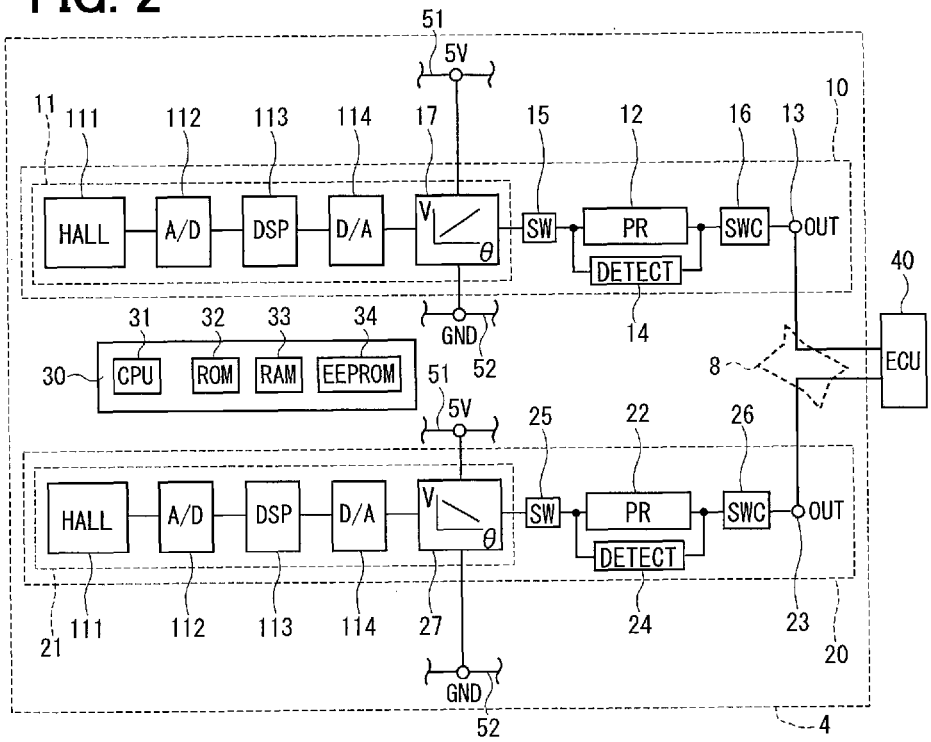
FIG. 2 is a block diagram of an electric circuit of the position detecting device according to the first embodiment.

As shown in FIG. 2, the first integrated circuit 10 includes a first voltage output circuit 11, a first protective resistor 12, a first output terminal 13, a first abnormality detection circuit 14, a first current shut-off switch 15 as first current shut-off part and a first voltage switching circuit 16.

The first voltage output circuit 11 includes a Hall element 111, an analog-digital (A/D) conversion circuit 112, a digital signal processor (DSP) 113, a digital-analog (D/A) conversion circuit 114 and a first conversion (amplifier) circuit 17. The Hall element 111 is formed of a thin film semiconductor and outputs an analog signal corresponding to variations in magnetic flux density. The first A/D conversion circuit 112 converts the analog signal outputted from the Hall element 111 to a corresponding digital signal.

The DSP 113 performs digital signal processing such as correction processing and rotation angle calculation processing relative to signals, which are outputted from the Hall element 111 and converted into the digital signals. The first D/A conversion circuit 114 converts the signal outputted from the DSP 113 to a corresponding analog signal.

Figure 3:
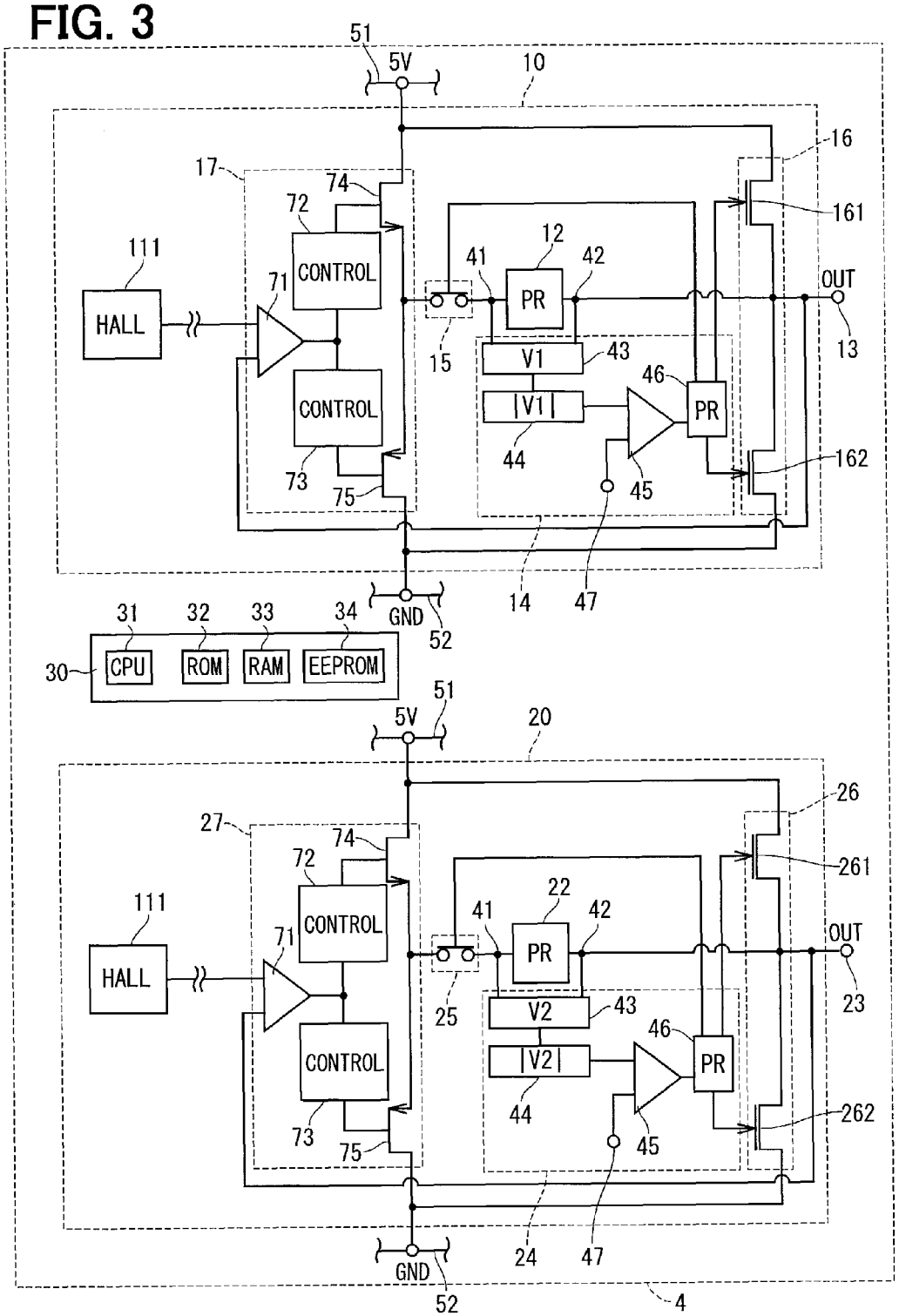
FIG. 3 is a circuit diagram of a main part of the electric circuit of the position detecting device according to the first embodiment.

The first conversion circuit 17 includes, as shown in FIG. 3, an operational amplifier 71, control circuits 72, 73 and transistors 74, 75. The first conversion circuit 17 is configured to convert an output signal outputted from the first D/A conversion circuit 114 to a voltage corresponding to the output signal. The first conversion circuit 17 is configured to increase its output voltage (first output voltage) V of the first voltage output circuit 11 in proportion to the angular position 8 of the throttle valve 1.

The first protective resistor 12 is connected to the first conversion circuit 17 to protect the first integrated circuit 10 from instantaneous large current. The first output terminal 13 is connectable electrically to the ECU 40 to output the output voltage of the first integrated circuit 10 to the ECU 40.

As shown in FIG. 3, the first abnormality detection circuit 14 includes a first terminal 41, a second terminal 42, a subtraction circuit 43, an absolute value circuit 44, a comparison circuit 45 and an abnormality processing circuit 46. The first terminal 41 and the second terminal 42 are connected to both ends of the first protective resistor 12. The subtraction circuit 43 is connected electrically to the first terminal 41 and the second terminal 42 to subject the voltage of the first protective resistor 12 to subtraction processing. Thus a potential difference (voltage) V1 between both ends of the first protective resistor 12 is calculated. The voltage V1 indicates a current flowing therethrough. The absolute value circuit 44 is connected electrically to the subtraction circuit 43 to perform absolute value processing on the potential difference V1 outputted from the subtraction circuit 43. Thus an absolute value |V1| of the potential difference V1 between both ends of the first protective resistor 12 is calculated.

The comparison circuit 45 is connected electrically to the absolute value circuit 44 to compare the absolute value |V1| outputted from the absolute value circuit 44 with a reference voltage Vr outputted from a reference voltage terminal 47. The comparison circuit 45 transmits a signal indicating a comparison result to an abnormality processing circuit 46. For example, when a large current flows in the first protective resistor 12 due to a short-circuit between the first output terminal 13 and a second output terminal 23, the absolute value of the absolute value circuit 44 becomes larger than the reference voltage Vr and the comparison circuit 45 outputs a high level signal ("1"). The comparison circuit 45 outputs a low level signal ("0"), however, when the absolute value of the absolute value circuit 44 is smaller than the reference voltage Vr. The output of high level signal outputted from the comparison circuit 45 of the first abnormality detection circuit 14 is a first abnormality detection signal.

An abnormality processing circuit 46 checks whether the large current flows in the first protective resistor 12 based on the output value (high or low) of the comparison circuit 45 and outputs a control signal. For example, when the output of the comparison circuit 45 of the first abnormality detection circuit 14 is the high level, the abnormality processing circuit 46 determines that the large current flows in the resistor 12 and outputs the control signal to the first current shut-off switch 15 and the first voltage switching circuit 16.

The first current shut-off switch 15 is provided between the first conversion circuit 17 and the first protective resistor 12. The first current shut-off switch 15 is a normally-on switch, which takes an on-state and an off-state when it is not driven and driven, respectively. The first current shut-off switch 15 is turned on when the first integrated circuit 10 is normal. The first current shut-off switch 15 is turned off by the control signal of the abnormality processing circuit 46 to shut off current flow between the first conversion circuit 17 and the first protective resistor 12, when the large current flows in the first protective resistor 12.

The first voltage switching circuit 16 is provided between the first protective resistor 12 and the first output terminal 13. Its one end and other end are connected electrically to a power supply line 51 and ground 52, respectively. The first voltage switching circuit 16 includes a first high potential-side switch (first HISW) 161 and a first low potential-side switch (first LOSW) 162, which are connected in series. The first HISW 161 has one end and the other end connected electrically to the power supply line 51 and the first LOSW 162, respectively. The first LOSW 162 has one end and the other end connected electrically to the first HISW 161 and the ground 52. A conductor (junction) between the first HISW 161 and the first LOSW 162 is connected to a conductor (junction) between the first protective resistor 12 and the first output terminal 13.

The first voltage switching circuit 16 controls an output voltage of the first output terminal 13 to be higher than an intermediate voltage developed between the power supply line 51 and the ground 52, when the first HISW 161 and the first LOSW 162 are turned on and off, respectively. That is, the first voltage switching circuit 16 controls the output voltage to a high potential (HI) side. The first voltage switching circuit 16 controls the output voltage of the first output terminal 13 to be lower than the intermediate voltage developed between the power supply line 51 and the ground 52, when the first HISW 161 and the first LOSW 162 are turned off and on, respectively. That is, the first voltage switching circuit 16 controls the output voltage to a low potential (LO) side.

In an abnormal case, in which the large current flows in the first protective resistor 12, the first voltage switching circuit 16 operates in response to the control signal of the abnormality processing circuit 46 of the first abnormality detection circuit 14 to control the output voltage of the first output terminal 13 to either the high potential side or the low potential side. Here, abnormal-time switch setting information is information, which indicates in case of abnormality which one of the first HISW 161 or the first LOSW 162 is to be turned on and which one of a second HISW 261 and a second LOSW 262 is to be turned on. This information is stored in a RAM 33 described later when an ignition switch of a vehicle is turned on (IGON-time). The first voltage switching circuit 16 is configured such that the first HISW 161 and the first LOSW 162 are turned on and off, respectively, when the current flowing in the first output terminal 13 is a flow-in current. The first voltage switching circuit 16 is configured such that the first HISW 161 and the first LOSW 162 are turned off and on, respectively, when the current flowing in the first output terminal 13 is a flow-out current. The flow-in current and the flow-out current will be described in detail later with reference to FIG. 4A and FIG. 4B.

The second integrated circuit 20 includes a second voltage output circuit 21, a second protective resistor 22, a second output terminal 23, a second abnormality detection circuit 24, a second current shut-off switch 25 and a second voltage switching circuit 26.

The second voltage output circuit 21 includes, similarly to the first voltage output circuit 11, the Hall element 111, the A/D conversion circuit 112, the DSP 113, the D/A conversion circuit 114 and a second conversion circuit 27. As shown in FIG. 3, the second conversion circuit 27 has the similar circuit configuration as the first conversion circuit 17. The second conversion circuit 27 is configured to decrease its output voltage (second output voltage) V of the second voltage output circuit 21 in proportion to the angular position 8 of the throttle valve 1. The second voltage switching circuit 26 has a second high potential-side switch (second HISW) 261 and a second low potential-side switch (second LOSW) 262, which have the same functions as the first HISW 161 and the first LOSW 162, respectively.

The second protective resistor 22, the second output terminal 23, the second abnormality detection circuit 24 and the second current shut-off switch 25 as second current shut-off part have the same configurations and functions as the first protective resistor 12, the first output terminal 13, the first abnormality detection circuit 14 and the first current shut-off switch 15, respectively, although these are located at different positions. For this reason, the second protective resistor 22, the second output terminal 23, the second abnormality detection circuit 24 and the second current shut-off switch 25 are not described.

For example, when a large current flows in the second protective resistor 22 due to the short-circuit between the first output terminal 13 and the second output terminal 23, the absolute value |V2| of the absolute value circuit 44 of the second abnormality detection circuit 24 becomes larger than the reference voltage Vr and the comparison circuit 45 of the second abnormality detection circuit 24 outputs the high level signal. The comparison circuit 45 of the second abnormality detection circuit 24 outputs the low level signal, however, when the absolute value |V2| of the absolute value circuit 44 of the second abnormality detection circuit 24 is smaller than the reference voltage Vr. The high level signal outputted from the comparison circuit 45 of the second abnormality detection circuit 24 is a second abnormality detection signal.

The microcomputer 30 includes a CPU 31, a ROM 32, a RAM 33 and an EEPROM 34. The CPU 31 performs a variety of arithmetic operation processing, information processing and controls. The ROM 32 stores programs required to perform such arithmetic operation processing, information processing and control processing.

The RAM 33 temporarily stores intermediate information produced in the course of the operation processing of the CPU 31. Such stored information is not maintained when the ignition switch is turned off. The abnormal-time switch setting information is stored in the RAM 33. The RAM 33 thus forms abnormal-time switch setting information storing part. The EEPROM 34 stores information required for the variety of arithmetic operation processing, the information processing and the control processing, when shipped, that is, when the rotation angle sensor 4 is manufactured. The EEPROM 34 stores information, which specifies application of the first integrated circuit 10 and the second integrated circuit 20. The EEPROM 34 is integrated circuit specifying information storing part.

Figure 4A:
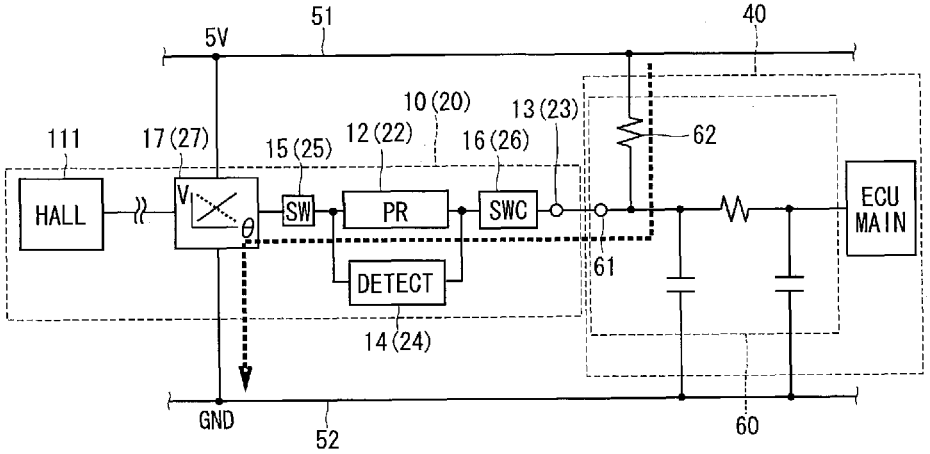
FIG. 4A and FIG. 4B are circuit diagrams showing a flow-in current and a flow-out current in the position detection device according to the first embodiment, respectively.
Figure 4B:
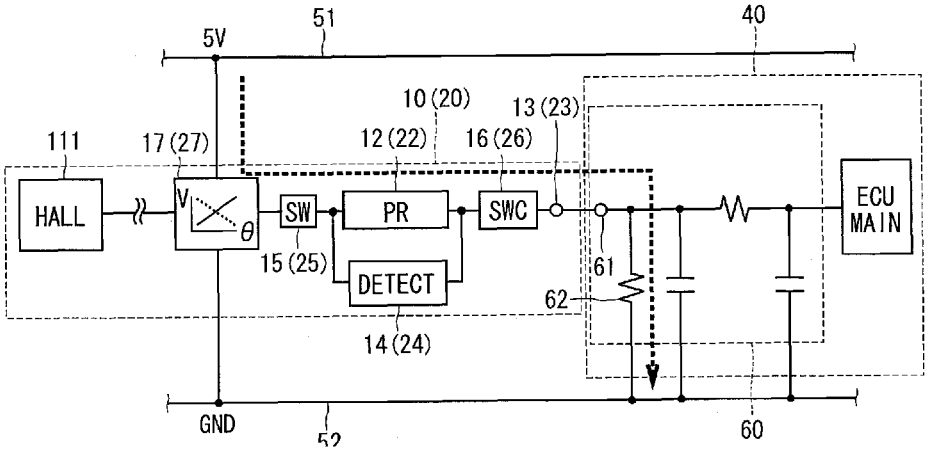

The flow-in current and the flow-out current are shown in FIG. 4A and FIG. 4B, which show a connection between the first integrated circuit 10 or the second integrated circuit 20 and an input circuit 60 of the ECU 40. In this figure, a current is shown to flow in a direction of an arrow of a dotted line for simplicity.

As shown in FIG. 4A, a resistor 62 is provided as a pull-up resistor between the power supply line 51 of the input circuit 60 and an input terminal 61 of the same. Since the pull-up resistor 62 is provided in the input circuit 60, the current flows to the first protective resistor 12 or the second protective resistor 22 from the ECU 40 side through the first output terminal 13 or the second output terminal 23, respectively, at the time of IGON (IGON time). The current flowing to the first output terminal 13 or the second output terminal 23 is referred to as a flow-in current.

As shown in FIG. 4B, the resistor 62 is provided as a pull-down resistor between the ground 52 of the input circuit 60 and the input terminal 61 of the ECU 40. Since the pull-down resistor 52 is provided in the input circuit 60, the current flows toward the ECU 40 from the first protective resistor 12 of the second protective resistor 22 through the first output terminal 13 or the second output terminal 23, respectively, at the time of IGON. The current flowing to the first output terminal 13 or the second output terminal 23 is referred to as a flow-out current.

Here, in a case that the pull-up resistor 62 is provided in the ECU 40 of the electronically-controlled throttle system and the rotation angle sensor 4 is applied to the electronically-controlled throttle system, the flow-in current flows to the first output terminal 13 and the second output terminal 23 as shown in FIG. 4A. The electronically-controlled throttle system requires that the output of the rotation angle sensor 4 is controlled to a HI side at the time of abnormality. Further, in a case that the pull-down resistor is provided in the ECU 40 of the accelerator pedal module and the rotation angle sensor 4 is applied to the accelerator pedal module, the flow-out current flows to the first output terminal 13 and the second output terminal 23. The accelerator module requires that the output of the rotation angle sensor 4 is controlled to a LO side at the time of abnormality.

Figures 5, 6A, 6B:
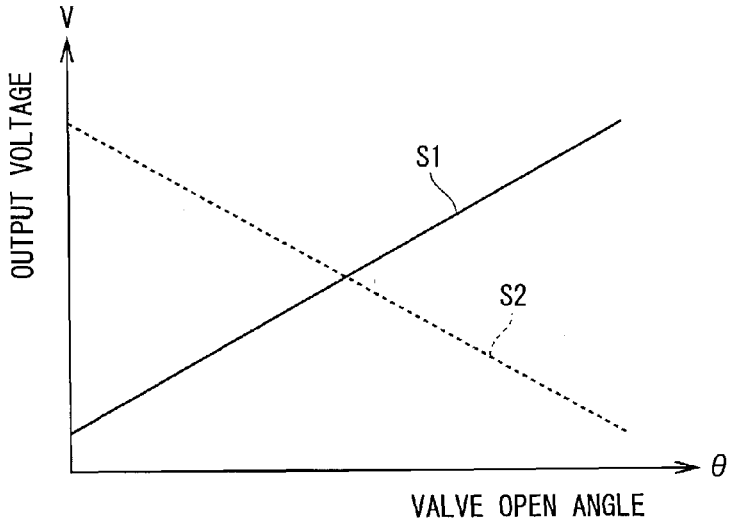
FIG. 5 is a graph showing output characteristics of a first integrated circuit and a second integrated circuit of the position detecting device according to the first embodiment.
FIG. 6A and FIG. 6B are illustrations of specific information about the integrated circuits and operations of a first current shut-off switch and a second current shut-off switch, respectively, in the position detecting device according to the first embodiment.

Setting and operation of the rotation angle sensor 4 will be described next with reference to FIG. 5 to FIG. 8. The setting at the time of manufacture or shipment will be described first. As shown in FIG. 5, a voltage signal S1 outputted as the first output voltage from the first integrated circuit 10 has an output characteristic (steadily increasing characteristic), in which the output voltage V increases as the open angle θ of the throttle value 1 increases. A voltage signal S2 outputted as the second output voltage from the second integrated circuit 20 has an output characteristic (steadily decreasing characteristic), in which the output voltage V decreases as the open angle θ of the throttle value 1 increases. That is, the voltage signals outputted from the first integrated circuit 10 and the second integrated circuit 20 of the rotation angle sensor 4 have a crossing (inverse or opposite) characteristic so that the sum of the two voltage signals S1 and S2 are constant. Thus, the ECU 40 is capable of checking whether the position detecting device 4 is operating normally.

As shown in FIG. 6A, "1" is written in a bit of the EEPROM 34, which specifies the first integrated circuit (first IC) 10, at the time of manufacture or shipment thereby to set that the first integrated circuit 10 is a control integrated circuit (control IC), which performs control operation. "0" is written in a bit of the EEPROM 34, which specifies the second integrated circuit (second IC) 20, thereby to set that the second integrated circuit 20 is a monitor integrated circuit (monitor IC), which performs monitor operation. When the first integrated circuit 10 having the steadily-increasing characteristic is set as the control integrated circuit, the ECU 40 controls driving of the throttle valve 1 based on variations of the voltage signal S1 of the first integrated circuit 10.

When the second integrated circuit 20 having the steadily-decreasing characteristic is set as the monitor integrated circuit, the ECU 40 monitors, for example, whether the output of the first integrated circuit 10 is abnormal (abnormality other than short-circuiting) by using a sum of the voltage signal S2 of the second integrated circuit 20 and the voltage signal S1 of the first integrated circuit 10.

Figures 7, 8:
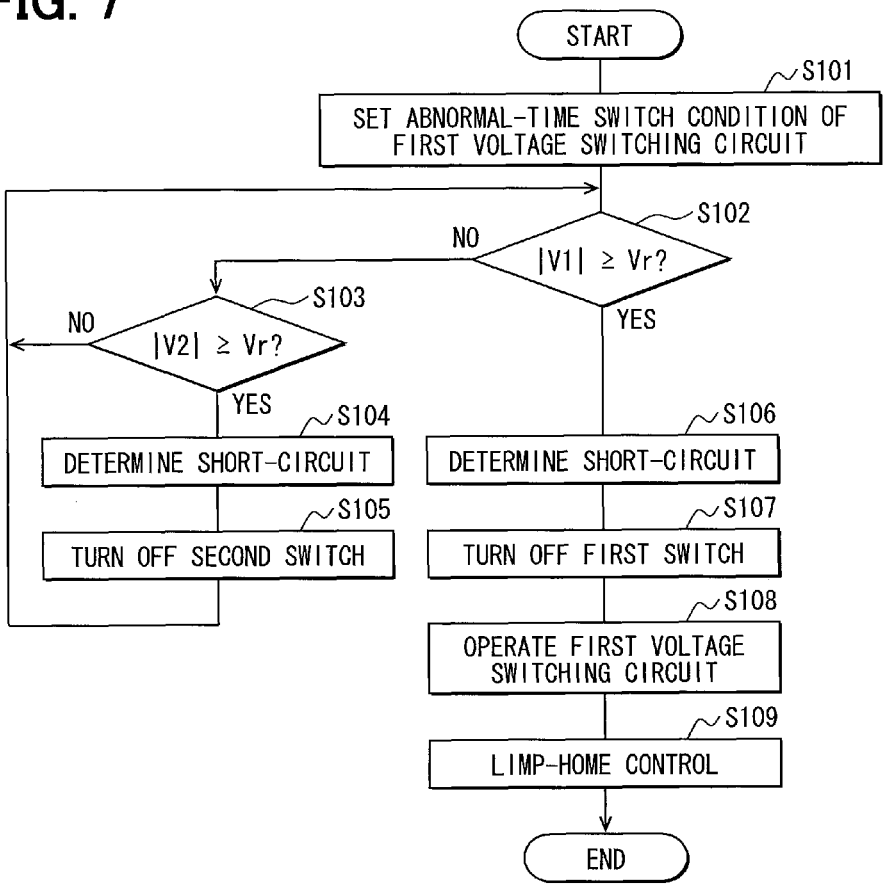
FIG. 7 is a flowchart showing abnormality detection processing of the position detecting device according to the first embodiment.
FIG. 8 is illustration showing abnormal-time switch setting information of the position detecting device according to the first embodiment.

Abnormality detection processing of the rotation angle sensor 4 will be described next with reference to FIG. 7.

When the ignition switch is turned on, S101 is executed. At S101, the abnormal-time switch setting of the first voltage switching circuit 16 is executed. This setting is executed based on the direction of current flowing to the first output terminal 13 at the IGON-time, that is, when the ignition switch is turned on. When the current flowing to the first output terminal 13 at the IGON-time is the flow-in current, "1" is written in the bit, which indicates the abnormal-time switch setting information of the first voltage switching circuit 16 in the RAM 33. Thus, the first HISW 161 is set to the on-state and the first LOSW 162 is set to the off-state by the control signal of the abnormality processing circuit 46 as shown in a table of FIG. 8. When the current flowing to the first output terminal 13 at the IGON-time is the flow-out current, "0" is written in the bit, which indicates the abnormal-time switch setting information of the first voltage switching circuit 16 in the RAM 33. Thus, the first HISW 161 is set to the off-state and the first LOSW 162 is set to the on-state by the control signal of the abnormality processing circuit 46 as shown in the table of FIG. 8. The current flowing to the first output terminal 13 at the IGON-time is the flow-in current and hence "1" is written in the bit of the first voltage switching circuit 16 in the RAM 33 indicating the abnormal-time switch setting information.

At S102 it is checked whether the absolute value |V1| is equal to or larger than the reference voltage Vr. When the absolute value |V1| is smaller than the reference voltage Vr and hence normal (S102:NO), the first current shut-off switch 15 is maintained in the on-state and S103 is executed. When the large current flows in the first protective resistor 12 because of abnormality and hence the absolute value |V1| becomes equal to or larger than the reference voltage Vr (S102:YES), S106 is executed.

At S103, it is checked whether the absolute value |V2| is equal to or larger than the reference voltage Vr. When the absolute value |V1| is smaller than the reference voltage Vr and hence normal (S103:NO), the second current shut-off switch 25 is maintained in the on-state and S103 is executed. When the large current flows in the second protective resistor 22 because of abnormality and hence the absolute value |V2| becomes equal to or larger than the reference voltage Vr, S104 is executed.

It is determined by the second abnormality detection circuit 24 at S104 that the first output terminal 13 and the second output terminal 23 are short-circuited. The abnormality processing circuit 46 of the second abnormality detection circuit 24 transmits the control signal to the second switch 25. The second current shut-off switch 25 is turned off at S105 by the control signal of the abnormality processing circuit 46 of the second abnormality detection circuit 24 as shown in FIG. 6B. Then S102 is executed again.

It is determined by the first abnormality detection circuit 14 at S106 that the first output terminal 13 and the second output terminal 23 are short-circuited. The abnormality processing circuit 46 of the first abnormality detection circuit 14 transmits the control signal to the first switch 15 and the first voltage switching circuit 16.

The first switch 15 is turned off at S107 by the control signal of the abnormality processing circuit 46. As a result, the current flow between the first conversion circuit 17 and the first protective resistor 12 is shut off as shown in FIG. 6B.

At S108, the first voltage switching circuit 16 is driven by the control signal of the abnormality processing circuit 46. The first voltage switching circuit 16 is driven by the control signal of the abnormality processing circuit 46 of the first abnormality detection circuit 14. Thus, the first HISW 161 is turned on and the first LOSW 162 is turned off so that the output voltage of the first integrated circuit 10 is controlled to the HI side as shown in FIG. 8.

At S109, the ECU 40 switches over a travel mode to a limp-home travel operation mode. Specifically, the ECU 40 controls the vehicle to maintain minimum travel ability for making limp-home traveling on road shoulder.

As described above, according to the first embodiment, the first integrated circuit 10 includes the first abnormality detection circuit 14 and the second integrated circuit 20 includes the second abnormality detection circuit 24. Thus, when the first output terminal 13 and the second output terminal 23 are short-circuited by a foreign matter 8 as shown in FIG. 2 for example, the large current flows in the first protective resistor 12 or the second protective resistor 22 and hence the voltage between both ends of the first protective resistor 12 or the second protective resistor 22 increases. When the large current flows in the first protective resistor 12 and the absolute value |V1| of the voltage between both ends of the first protective resistor 12 equals or exceeds the reference voltage Vr, the comparison circuit 45 of the first abnormality detection circuit 14 outputs the high level signal. When the large current flows in the second protective resistor 22 and the absolute value |V2| of the voltage between both ends of the second protective resistor 22 equals or exceeds the reference voltage Vr, the comparison circuit 45 of the second abnormality detection circuit 24 outputs the high level signal. It is thus possible to detect the short-circuit between the first output terminal 13 and the second output terminal 23.

Here a comparative example will be described with reference to FIG. 9. The comparative example is assumed to be a rotation angle sensor, which does not include the first abnormality detection circuit 14, the first switch 15, the first voltage switching circuit 16, the second abnormality detection circuit 24, the second switch 25 and the second voltage switching circuit 26 of the rotation angle sensor 4. That is, this comparative example is similar to the conventional detecting device described in the background art.

When the first output terminal 13 and the second output terminal 23 are short-circuited by a conductive foreign matter 8, for example, as shown in FIG. 9, the first output terminal 13 and the second output terminal 23 are electrically connected. The current flows from the power supply line 51 to the ground 52 through the first protective resistor 12 and the second protective resistor 22. The voltages of the first output terminal 13 and the second output terminal 23 both become the intermediate voltage 2.5 V. In this case, this sum equals the sum of the output voltages of the first output terminal 13 and the second output terminal 23, which are in the normal condition. It is hence not possible to detect the abnormality of the short-circuit between the first output terminal 13 and the second output terminal 23.

According to the first embodiment, however, since the first abnormality detection circuit 14 and the second abnormality detection circuit 24 are provided, it is possible to detect the abnormality, which includes the short-circuit between the first output terminal 13 and the second output terminal 23.

Further, according to the first embodiment, the first current shut-off switch 15 is provided between the first conversion circuit 17 and the first protective resistor 12 and the second current shut-off switch 25 is provided between the second conversion circuit 27 and the second protective resistor 22. Thus, even when the first output terminal 13 and the second output terminal 23 are short-circuited, it is possible to prevent the large current from flowing to the first integrated circuit 10 or the second integrated circuit 20 by shutting off the current flow between the second voltage output circuit 21 and the first protective resistor 12 or between the second voltage output circuit 21 and the second protective resistor 22.

In addition, the first integrated circuit 10 is provided with the first HISW 161 and the first LOSW 162 and the second integrated circuit 20 is provided with the second HISW 261 and the second LOSW 262. As a result, when abnormality such as a short-circuit arises between the first output terminal 13 and the second output terminal 23, the output voltage of the first output terminal 13 or the second output terminal 23 can be controlled to the high potential side or the low potential side.

The EEPROM 34 is provided to store the information, which specifies the control integrated circuit and the monitor integrated circuit. By writing "1" in the bit of the EEPEOM 34, which specifies the application of the first integrated circuit 10, the first integrated circuit 10 is set as the control integrated circuit. By writing "0" in the bit of the EEPEOM 34, which specifies the application of the second integrated circuit 20, the second integrated circuit 20 is set as the monitor integrated circuit. The ECU 40 can thus control driving of the throttle valve 1 based on the output of the first integrated circuit 10 and monitor the output of the first integrated circuit 10 based on the output of the second integrated circuit 20.

Further, the first integrated circuit 10 is set as the control integrated circuit and the second integrated circuit 20 is set as the monitor integrated circuit. Thus, it is not necessary to perform processing of specifying the control integrated circuit and the monitor integrated circuit and processing load can be reduced.

The RAM 33 is provided to store the abnormal-time switch setting information. It is thus possible to turn on, based on the information stored in the RAM 33, either one of the first HISW 161 and the first LOSW 162 based on the control signal of the abnormality processing circuit 46 of the first abnormality detection circuit 14 and either one the second HISW 261 and the second LOSW 262 by the control signal of the abnormality processing circuit 46 of the second abnormality detection circuit 24.

The abnormal-time switch setting information is stored in the RAM 33 at the IGON-time. Thus, the abnormal-time switch setting information, which is different among different applications such as the electronically-controlled throttle system and the accelerator pedal module, is automatically stored in the RAM 33. It is therefore not necessary to pre-store different abnormal-time switch setting information in correspondence to different applications. As a result, the information setting work at the time of shipment can be eliminated. In addition, the rotation angle sensor 4 need not be configured differently in correspondence to different applications. The same rotation angle sensor 4 can be used in different applications.

Second Embodiment

A position detecting device according to a second embodiment will be described with reference to FIG. 3 and FIG. 10. According to the second embodiment, abnormal-time switch setting information is different from that of the first embodiment. Here only difference from the first embodiment will be described and the similar configuration as that of the first embodiment will not be described.

According to the second embodiment, at the time of manufacture or shipment, the first integrated circuit 10 is set as the control integrated circuit and the second integrated circuit 20 is set as the monitor integrated circuit. The first HISW 161, the first LOSW 162, the second HISW 261 and the second LOSW 262 are set to be always in the off-state.

When the absolute value |V1| of the first integrated circuit 10 is equal to larger than the reference voltage Vr at the time of abnormality detection processing, the control signal is transmitted to the first current shut-off switch 15 by the abnormality processing circuit 46 of the first abnormality detection circuit 14. The first current shut-off switch 15 is turned off by the control signal of the abnormality processing circuit 46. The current flow between the first conversion circuit 17 and the first protective resistor 12 is interrupted. At this time the ECU 40 uses the second integrated circuit 20, which was originally set as the monitor integrated circuit, as the control integrated circuit, and controls driving of the throttle valve 1 based on the output of the second integrated circuit 20.

When the absolute value |V2| of the second integrated circuit 20 is equal to larger than the reference voltage Vr at the time of abnormality detection processing, the control signal is transmitted to the second current shut-off switch 25 by the abnormality processing circuit 46 of the first abnormality detection circuit 14. The second current shut-off switch 25 is turned off by the control signal of the abnormality processing circuit 46. The current flow between the second conversion circuit 27 and the second protective resistor 22 is interrupted. At this time, the ECU 40 controls driving of the throttle valve 1 based on the output of the first integrated circuit 10.

As described above, according to the second embodiment, the first HISW 161, the first LOSW 162, the second HISW 261 and the second LOSW 262 are set to be normally in the off-state. When it is determined that the first output terminal 13 and the second output terminal 23 are short-circuited, the first current shut-off switch 15 is turned off by the control signal of the abnormality processing circuit 46. It is thus possible to maintain the control although it is not possible to monitor the control integrated circuit.

Third Embodiment

A position detecting device according to a third embodiment will be described with reference to FIG. 3 and FIG. 11A, FIG. 11B. According to the third embodiment, abnormal-time switch setting information is different from that of the first embodiment. Here only difference from the first embodiment will be described and the similar configuration as that of the first embodiment will not be described.

According to the third embodiment, information indicating abnormal-time switch setting information of the first voltage switching circuit 16 is stored in the EEPROM 34 at the time of manufacture or shipment. As shown in FIG. 11A, in a case that the rotation angle sensor 4 is applied to the electronically-controlled throttle system, "1" is written in the bit of the EEPROM 34 indicating the abnormal-time switch setting information of the first voltage switching circuit 16. Thus the first HISW 161 and the first LOSW 162 are set in the on-state and the off-state by the control signal of the abnormality processing circuit 46, respectively. In a case that the rotation angle sensor 4 is applied to the accelerator pedal module, "0" is written in the bit of the EEPROM 34 indicating the abnormal-time switch setting information of the first voltage switching circuit 16. Thus the first HISW 161 and the first LOSW 162 are set in the off-state and the on-state by the control signal of the abnormality processing circuit 46, respectively.

As described above, according to the third embodiment, the abnormal-time switch setting information of the first voltage switching circuit 16 and the abnormal-time switch setting information of the second voltage switching circuit 26 are stored in the EEPROM 34. Thus the abnormal-time switch setting can be attained surely. Since it is not necessary to check the type of different applications, processing load in the operation time can be reduced.

Other Embodiments

In the above-described embodiments, the first current shut-off switch 15 and the second current shut-off switch 25 are provided in the first integrated circuit 10 and the second integrated circuit 20, respectively. However, the other embodiment may be configured without the first current shut-off switch 15 and the second shut-off switch 25.

In the above-described embodiments, the first voltage switching circuit 16 and the second voltage switching circuit 26 are provided in the first integrated circuit 10 and the second integrated circuit 20, respectively. However, the other embodiment may be configured without the first voltage switching circuit 16 and the second voltage switching circuit 26.

In the above-described embodiments, the information specifying the control integrated circuit and the monitor integrated circuit are stored in the EEPROM 34 of the microcomputer. However, the other embodiment may be configured such that processing for specifying the control integrated circuit and the monitor integrated circuit is performed at the IGON time and such information specifying the control integrated circuit and the monitor integrated circuit are stored in the RAM 33.

According to the above-described embodiments, the position detecting device is applied to the electronically-controlled throttle system and the output voltage of the position detecting device is controlled to the high potential side at the time of abnormality. However, the other embodiment may be configured such that the position detecting device is applied to the accelerator pedal module and the output voltage of the position detecting device is controlled to the low potential side at the time of abnormality.

According to the above-described embodiments, the first integrated circuit 10 and the second integrated circuit 20 are set as the control integrated circuit and the monitor integrated circuit, respectively. However, the other embodiment may be configured such that the first integrated circuit 10 and the second integrated circuit 20 are set as the monitor integrated circuit and the control integrated circuit, respectively.

According to the above-described embodiments, the first voltage output circuit 11 and the second voltage output circuit 21 are configured to produce the first output voltage and the second output voltage, which increases and decreases in proportion to the position of the movable body, respectively. However, the other embodiment may be configured such that the first output voltage and the second output voltage varies in opposite directions, that is, not necessarily in proportion or linearly to the position of the movable body.

What is claimed is:

1. A position detecting device for outputting a voltage to an electronic control unit, which controls a movable body, in accordance with a position of the movable body, the voltage being limited to a voltage of a power source, the position detecting device comprising:

a first integrated circuit including a first voltage output circuit for outputting a first voltage increasing linearly with movement of the movable body, a first protective resistor having one end side connected to the first voltage output circuit, a first output terminal connecting an other end side of the first protective resistor to the electronic control unit, and a first abnormality detection circuit for outputting a first abnormality detection signal based on a potential difference between both ends of the first protective resistor; and a second integrated circuit including a second voltage output circuit for outputting a second voltage decreasing with movement of the movable body, a second protective resistor having one end side connected to the second voltage output circuit, a second output terminal connecting an other end side of the second protective resistor to the electronic control unit, and a second abnormality detection circuit for outputting a second abnormality detection signal based on a potential difference between both ends of the second protective resistor.

2. The position detecting device according to claim 1, wherein:

the first integrated circuit includes a first current shut-off part provided between the first signal output circuit and the first protective resistor to interrupt a current flowing between the first signal output circuit and the first protective resistor when the first abnormality detection circuit outputs the first abnormality detection signal; and the second integrated circuit includes a second current shut-off part provided between the second signal output circuit and the second protective resistor to interrupt a current flowing between the second signal output circuit and the second protective resistor when the second abnormality detection circuit outputs the second abnormality detection signal.

3. The position detecting device according to claim 2, wherein:

the first integrated circuit includes a first high potential-side switch that has one end connected to a high potential side of the power supply source and an other end connected between the first protective resistor and the first output terminal, and turns on or off in accordance with the first abnormality detection signal, and a first low potential-side switch that has one end connected between the first protective resistor and the first output terminal and an other end connected to a low potential side of the power supply source, and turns off or on in accordance with the first abnormality detection signal; and the second integrated circuit includes a second high potential-side switch that has one end connected to the high potential side of the power supply source and an other end connected between the second protective resistor and the second output terminal, and turns on or off in accordance with the second abnormality detection signal, and a second low potential-side switch that has one end connected between the second protective resistor and the second output terminal and an other end connected to the low potential side of the power supply source, and turns off or on in accordance with the second abnormality detection signal.

4. The position detecting device according to claim 2, further comprising:

an integrated circuit specifying information storing part for storing integrated circuit specifying information that specifies one of the first integrated circuit and the second integrated circuit as a control integrated circuit, which outputs a voltage for controlling the movable body, and specifies an other of the first integrated circuit and the second integrated circuit as a monitor integrated circuit, which monitors the control integrated circuit.

5. The position detecting device according to claim 1, wherein:

the first integrated circuit includes a first high potential-side switch that has one end connected to a high potential side of the power supply source and an other end connected between the first protective resistor and the first output terminal, and turns on or off in accordance with the first abnormality detection signal, and a first low potential-side switch that has one end connected between the first protective resistor and the first output terminal and an other end connected to a low potential side of the power supply source, and turns off or on in accordance with the first abnormality detection signal; and the second integrated circuit includes a second high potential-side switch that has one end connected to the high potential side of the power supply source and an other end connected between the second protective resistor and the second output terminal, and turns on or off in accordance with the second abnormality detection signal, and a second low potential-side switch that has one end connected between the second protective resistor and the second output terminal and an other end connected to the low potential side of the power supply source, and turns off or on in accordance with the second abnormality detection signal.

6. The position detecting device according to claim 5, further comprising:

an abnormal-time switch setting information storing part for storing abnormal-time switch setting information that specifies either one of the first high potential-side switch and the first low potential-side switch is to be turned on in response to the first abnormality detection signal, and specifies either one of the second high potential-side switch and the second low potential-side switch is to be turned on in response to the second abnormality detection signal.

7. The position detecting device according to claim 6, wherein:

the abnormal-time switch setting information storing part is a volatile memory.

8. The position detecting device according to claim 6, wherein:

the abnormal-time switch setting information storing part is a non-volatile memory.

9. The position detecting device according to claim 5, wherein:

all of the first high potential-side switch, the first low potential-side switch, the second high potential-side switch and the second low potential-side switch are turned off in response to any one of the first abnormality detection signal and the second abnormality detection signal.

10. The position detecting device according to claim 1, further comprising:

an integrated circuit specifying information storing part for storing integrated circuit specifying information that specifies one of the first integrated circuit and the second integrated circuit as a control integrated circuit, which outputs a voltage for controlling the movable body, and specifies an other of the first integrated circuit and the second integrated circuit as a monitor integrated circuit, which monitors the control integrated circuit.

11. The position detecting device according to claim 10, wherein:

the integrated circuit specifying information storing part is a non-volatile memory.

12. The position detecting device according to claim 10, further comprising:

an abnormal-time switch setting information storing part for storing abnormal-time switch setting information that specifies either one of the first high potential-side switch and the first low potential-side switch is to be turned on in response to the first abnormality detection signal, and specifies either one of the second high potential-side switch and the second low potential-side switch is to be turned on in response to the second abnormality detection signal.

13. The position detecting device according to claim 12, wherein:

the abnormal-time switch setting information storing part is a volatile memory.

14. The position detecting device according to claim 12, wherein:

the abnormal-time switch setting information storing part is a non-volatile memory.

15. The position detecting device according to claim 1, wherein:

the first voltage output circuit and the second voltage output circuit are configured to output the first voltage and the second voltage, which increases and decreases with an increase in the position of the movable body, respectively, so that a sum of the first voltage and the second voltage is constant when the position detecting device is normal.

16. The position detecting device according to claim 1, wherein the first voltage and the second voltage increases and decreases linearly in a same region of movement of the movable body, respectively.

* * * * *